United States Patent [19]

Zelaschi

[11] Patent Number: 4,775,316

[45] Date of Patent: Oct. 4, 1988

[54] ROLLER FURNACE PROVIDED WITH A PASSAGE FOR THE DRYING AND/OR REFIRING OF CERAMIC OR REFRACTORY PRODUCTS

[75] Inventor: Roberto Zelaschi, Milan, Italy

[73] Assignee: Welke Industriale S.P.A., Milan, Italy

[21] Appl. No.: 51,953

[22] Filed: May 13, 1987

[30] Foreign Application Priority Data

May 22, 1986 [IT] Italy ..... 21939/86[U]

[51] Int. Cl.[4] ..... F27B 9/02

[52] U.S. Cl. ..... 432/128; 432/236; 432/133

[58] Field of Search ..... 432/128, 133, 137, 144, 432/146, 152, 153, 164; 34/211, 216

[56] References Cited

U.S. PATENT DOCUMENTS

| | | | |
|---|---|---|---|
| 587,161 | 7/1897 | Prinz | 34/211 X |
| 1,197,393 | 9/1916 | Petersen | 432/128 |
| 4,154,576 | 5/1979 | Bossette | 432/128 |
| 4,285,669 | 8/1981 | Walchhutter | 432/82 |
| 4,531,304 | 7/1985 | Wauhop, Jr. et al. | 34/211 X |
| 4,548,191 | 10/1985 | Hwang | 34/211 X |

*Primary Examiner*—William E. Tapolcai
*Attorney, Agent, or Firm*—Michael J. Striker

[57] ABSTRACT

A roller furnace having a passage (3) for the firing of ceramic or refractory products, such as tiles and the like, is provided with a passage (6) running parallel to, and arranged below the firing passage (3) for effecting a heat treatment on a product, possibly with hot gases removed from the firing passage (3).

19 Claims, 2 Drawing Sheets

ROLLER FURNACE PROVIDED WITH A PASSAGE FOR THE DRYING AND/OR REFIRING OF CERAMIC OR REFRACTORY PRODUCTS

BACKGROUND OF THE INVENTION

This invention relates to a roller furnace for firing ceramic or refractory products, such as tiles and the like, which is provided with a passage running parallel to, and arranged below the firing furnace, in which products are heat treated possibly by the utilization of hot gases removed from the firing furnace.

Processes for producing ceramic articles may be said to fall into two broad categories of types : the single-firing type and the double-firing type.

In a single-firing or -baking process, the pressed, dried and possibly glazed product is baked only once.

In a double-firing process, on the other hand, the pressed and dried product is subjected to a first firing operation to obtain the so-called biscuit, and the biscuit is glazed and, after drying of the glaze, subjected to a second firing operation, or refiring.

By the double-firing process, products are obtained which are improved qualitatively, such for example as facing tiles or even paving tiles or slabs that are decorated on their visible face.

Both the single-firing and double-firing processes are widely used by the ceramic industry in order to answer different market-demands.

The drying as well as the 'bi-baking' of tiles are operations being usually carried out on equipments separated from the firing furnace proper.

In order to increase versatility of the roller furnaces, U.S. Pat. No. 4,285,669 has proposed to provide a drying passage below the firing furnace and to supply it with hot gases obtained from several sections of the furnace.

Such an installation is used in particular for single-firing operations and has an advantage in that at the same time as tiles travelling in the furnace are fired, other tiles moving in the underlying dryer are dried.

The refiring operation that is necessary for producing bi-baked tiles, is at present carried out on a separate installation that may be a tunnel furnace or kiln having support plates for the tiles, or even a roller furnace.

Such a type of installation cannot be used for productions other than that involving the forming of a biscuit.

Thus, with to-day's installations, there is no possibility of diversifying the production that is, effecting drying of the tiles by single firing and bi-baking the tiles by refiring them.

SUMMARY OF THE INVENTION

The object of the invention is to allow diversified production to be achieved by providing an installation that can be utilized both as a dryer and as a bi-baking dryer.

The roller furnace according to the invention, of the type comprising a ware moving bed formed by individually driving rollers, provided with a passage running parallel to, and beneath the furnace and having, in turn, a ware moving bed formed by individually driving rollers, is characterized in that this latter passage can be selectively used as a dryer or as a bi-baking dryer.

When said underlying passage is to work as a dryer, it is supplied with hot air obtained from at least two sections of the overlying firing furnace, whereas when it works as a bi-baking dryer it is supplied in a self-controlled manner for effecting baking of the biscuit and is able to become entirely independent of the overlying furnace.

The above and other features of the invention will be best understood from a reading of the following detailed description given in relation to one embodiment thereof which is shown by way of a non-limiting example in the accompanying drawings,

DESCRIPTION OF THE PREFERRED EMBODIMENTS

Figure 2:
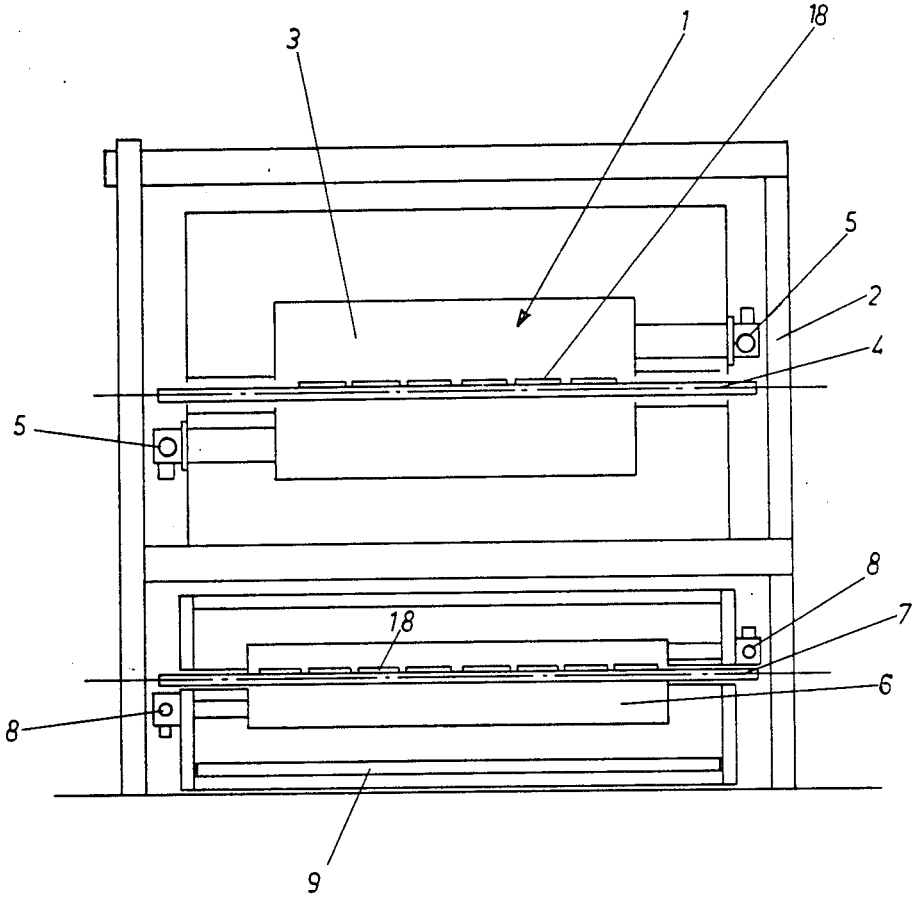
FIG. 2 is a schematic cross-sectional view of same furnace.

With reference to the drawings and firstly to FIG. 2 thereof, shown at 1 is a roller furnace for firing ceramic or refractory materials - in particular tiles - which comprises an outer bearing structure 2 and a firing passage 3 defined by refractory walls.

The moving means for the material to be fired is comprised of a series of parallel rollers 4 transversely directed with respect to the travel direction of the material, the rollers 4 being individually driving rollers.

As is customary, placed above and below the roller plane are burners 5 communicating with the firing chamber 3.

A second passage 6 is provided beneath the firing passage 3, this second passage 6 being thermally insulated from, and greater in width than the passage 3 for reasons to be explained further.

The passage 6 is also provided with a product-moving bed formed of rollers 7 being themselves individually driving rollers.

Arranged above and beneath the plane of rollers 7 are burners 8 that communicate with chamber 6.

Figure 1:
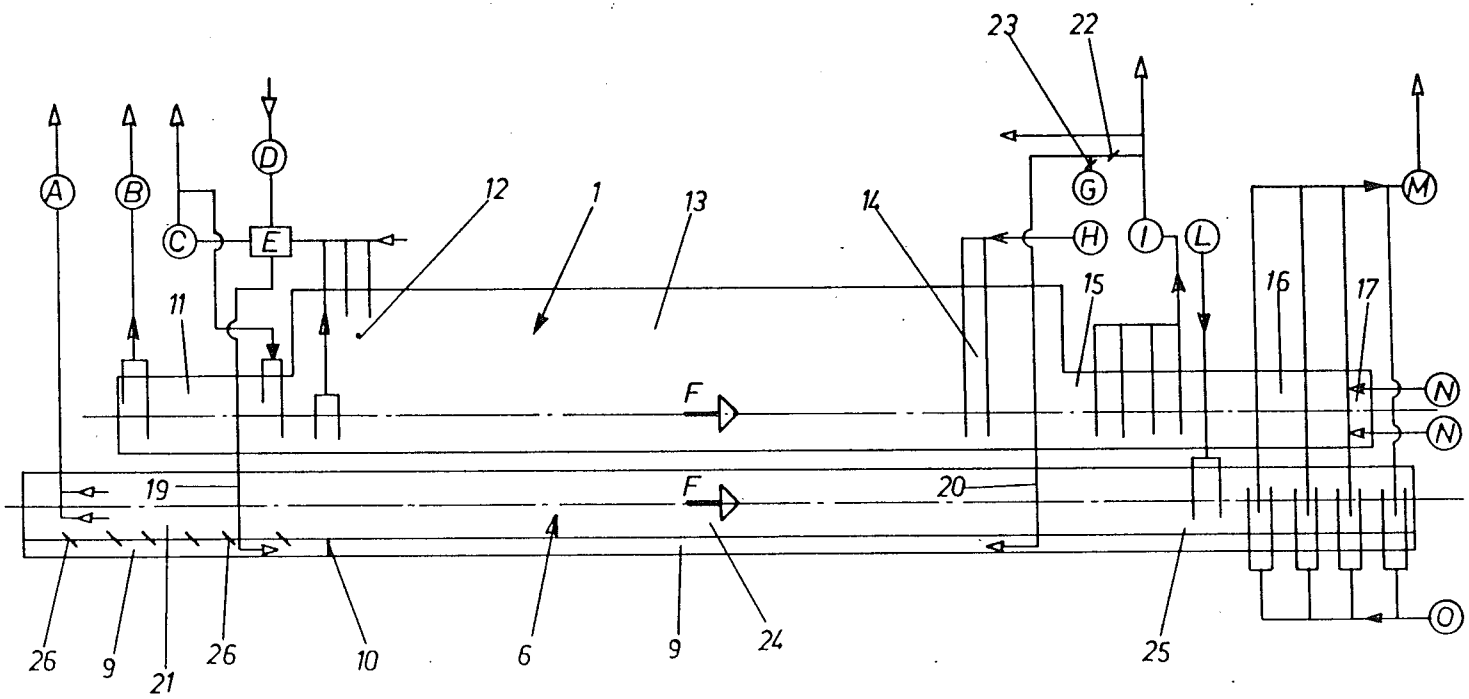
FIG. 1 is a schematic, longitudinal side-view of a furnace according to the invention.

A conduit 9 extends beneath and parallel to the chamber 6 and is communicated with chamber 6 through the burners 8 or via adjustable valve means 26 placed in the initial portion 21 of said chamber 6 (see FIG. 1).

The conduit 9 has a partition element 10 arranged near the initial portion thereof, which is to divide the conduit 9 into two parts.

In a conventional manner, the roller furnace 1 is composed of a prefurnace 11 from which the combustion gases are removed and passed to exhaust by means of a fan B, and a firing furnace proper which comprises a first preheating and degassing portion 12 from where the fumes are removed by a fan C through a heat exchanger E to be passed in part to exhaust and in part to prefurnace 11, and a second portion 13 that is subjected to the firing temperature proper.

Next coming in order are a portion 14 in which the fired ware is submitted to forced-air cooling by fresh air drawn-in from atmosphere through a fan H, and a portion 15 from which air introduced through fan H and heated in contact with the ware is drawn-off by a fan I to be in part recycled to the furnace or exhausted to atmosphere.

Finally, a naturally cooled portion 16 is provided and terminates in a further cooling zone 17 in which a fresh flow of air drawn-in from atmosphere by fans N is directed so as to cause the ware to be swept both from above and from below.

In FIG. 1, the arrows F on the dot-dash lines depicting the plane of rollers 4 and 7, show the direction of travel of tiles 18 (see FIG. 2) in the furnace 1 and the underlying passage 6.

According to the basic feature of this invention, the passage 6 running parallel to and beneath the kiln 1, may be utilized indifferently for drying the pressed tiles that are to be delivered, possibly after glazing, to kiln 1 in a single-firing process, and for drying and refiring the pressed tiles which, following to glazing and glaze-drying, are to be subjected to a second firing operation in a double- or bi-baking process.

When the passage 6 works as a dryer, it is entirely supplied with hot fumes recovered from kiln 1.

In particular, a first recovery is effected in the preheating zone 12 of furnace 1, in which zone provision is already made, as mentioned before, for removing hot gases via fan C to pass them in part to exhaust and in part to prefurnace 11 of furnace 1.

A portion of these hot gases, which can obviously be regulated in quantity, are passed—arrow 19, FIG. 1—to the conduit 9 extending underneath the passage 6, to be admitted to this latter via the valve means 26.

A second hot-gas recovery from furnace 1 takes place at the drawing-off portion 15 which follows the forced-air cooled portion 14, and in which—as said above—a suction fan I is provided which supplies said gases partly to exhaust and partly as a recycle to the furnace 1.

A portion of these hot gases, which can obviously be regulated in quantity, is supplied—arrow 20—to the conduit 9 and hence to the drying passage 6 through openings in burners 8 which, in this case, do not burn fuel and, thus, are 'off'.

These two hot-gas recoveries from furnace 1 are sufficient to create a hot air stream inside the passage 6 which smoothly sweeps in countercurrent relationship the ware to be dried and which will be drawn-off at the inlet of the dryer by a fan A.

The time for the ware to be dried is about 13–14 min in duration and the speed of rotation of rollers 7 is adjusted so as to allow the ware to remain for that time inside the dryer 6.

Since the time for firing the ware in furnace 1 is about 30/40 min, the dryer 6 whose production greatly exceeds the production of the furnace, ensures that a good supply of dried tiles is on hand. Increased production of the dryer is also due to the passage 6 being greater in width than the passage 3 of kiln 1. The fact of the passage 6 being greater in width is, in any way, of more significance when it is utilized as a biscuitbaking dryer, in order to ensure that a stock of biscuit-product is on hand for supplying subsequently the furnace 1 therewith, as explained further in the following.

When the passage 6 works as a biscuit-baking dryer, the first hot-gas recovery is still effected from the preheating zone 12 of furnace 1, the hot gases being supplied to the initial portion of conduit 9 where, due to the presence of partition wall 10 in same conduit, they are not affected by treatment on the ware in the subsequent portion.

Thus, in the initial portion 21 of passage 6, drying of the ware takes place by hot gases from the furnace 1, while in the next portion 24, the baking of the biscuit is effected and comprises, in turn, a preheating and degassing step followed by a baking step proper.

In this case, the withdrawal of hot air from section 15 of the furnace 1 is cut off by closing a valve means 22 provided on the delivery conduit 20, and comburent air drawn-in from atmosphere via a fan G is allowed to pass through conduit 20 to burners 8, by opening a valve means 23 connecting the fan G with conduit 20.

This comburent air is mixed with gas supplied to the burners through appropriate pipes, not shown, to cause burning to occur.

Thus, in the intermediate portion 24 of passage 6, the preheating and baking of the biscuit is carried out.

In the terminal portion 25 of passage 6, the baked product is subjected to a force-air cooling with fresh air drawn-in from atmosphere through a fan L and, in going on, again to a flow of fresh air blowing from a fan O.

Then, the cooling air is drawn-off by means of a fan M and is passed to exhaust or even recycled.

For example, air sucked by fan M out of passage 6 may be supplied to a recycling fan D of exchanger E and, through the pipe 19, to the initial portion 21 of passage 6 for drying the ware therein.

In this way, therefore, the biscuit-baking dryer is made completely independent of kiln 1.

The combustion gases in passage 6 will be drawn-off through fan A.

The drying and biscuit-baking process in passage 6 is carried out over a time of about 40 min, this time being divided into three substantially equal periods required, respectively, for effecting the drying step in the initial portion 21, the preheating and baking step in the intermediate portion 24, the cooling step in the end portion 25.

Thus, in this case, by adjusting the speed of rotation of rollers 7, the travel velocity of the product is decreased so that, for the drying step in the initial portion 21 of passage 6, substantially the same dwell time of the product is obtained as when the passage 6 is utilized as a dryer only.

Since the total time for the drying and biscuit-baking step is about as long as, or is higher in duration than the time for firing the product in the overlying furnace 1, in order to secure a stock of biscuits for supplying the furnace 1, the width of passage 6 is selected to be greater than that of passage 3, as seen in FIG. 2 and mentioned hereinbefore.

The importance of the furnace embodying the invention resides in that it enables the production to be diversified according to requirements without recourse to be had to expensive and bulky additional installation for individual productions.

Obviously many changes as to the details of construction may be made to the above-described exemplary embodiment of a roller surface according to the invention, all of these changes being intended to fall within the scope of the invention as set forth in the appended claims.

I claim:

1. A roller furnace producing combustion gases and hot fumes, comprising:

a furnace structure having a furnace axis and defining a firing passage and defining a heat treatment passage parallel to said firing passage, said firing passage having a plurality of zones including a prefurnace zone (11) from which the combustion gases are removable, a preheating zone (12) in which the hot fumes are removable, a firing zone proper (13) formed to accomodate firing of wares at a firing temperature, a forced-air cooling zone (14) into which the wares after firing are enterable and fresh air is introducable to force-air cool the wares and thereby heat the fresh air and thus produce heated air, an air drawing-off zone (15) from which the heated air is removable, a natural cooling zone (16), and a further forced-air cooling zone (17) into which fresh air is introducable and directed to further force-air cool the wares;

first means (4) for moving the wares through at least a portion of said firing passage (3);

second means (7) for moving the wares through said heat treatment passage (6), said first means and said second means each including a movable bed consisting of a plurality of rotary, parallel, and individually drivable rollers each extending transversely of said furnace axis;

first firing means (5) for firing the wares in said firing passage; and means for alternatively utilizing said heat treatment passage as a dryer and as a biscuit-baker-dryer, said alternatively utilizing means including second means (8) for firing the wares in said heat treatment passage so as to biscuit bake the wares, and also including drying means for drying the wares in said heat treatment passage as the wares move through said heat treatment passage by said second moving means, said drying means including means for recovering heat (C, I) produced from at least one of said firing means (5, 8) and means for conveying said heat recovered to said heat treatment passage.

2. The roller furnace as defined in claim 1, wherein said alternatively utilizing means includes first means for recovering heat from the hot fumes removable from said preheating zone and second means for recovering heat from the heated air removable from said air drawing-off zone, said first means for moving the wares being arranged to move the wares from said first mentioned forced-air cooling zone immediately to said air drawing-off zone, said first means for recovering heat and said second means for recovering heat each including a respective fan and associated delivery conduit leading to said heat treatment passage from said preheating zone so that said heat treatment passage is thereby alternatively utilizable as a dryer.

3. The roller furnace as defined in claim 1, wherein said second moving means is is formed to vary a speed of rotation of said rollers of said second moving means to suit said heat treatment passage being utilized as said dryer and to suit said heat treatment passage being utilized as said biscuit-baker-dryer.

4. The roller furnace as defined in claim 1, wherein said alternatively utilizing means includes means for recovering heat from the hot fumes removable from said preheating zone and including a first conduit, said alternatively utilizing means also including means for recovering heat from said heat treatment passage and including a second conduit, said alternatively utilizing means further including common conduit means communicating with said first conduit and said second conduit, said common conduit means being arranged parallel to, underneath and in communication with said heat treatment passage.

5. The roller furnace as defined in claim 4, wherein said common conduit means includes a partition separating said common conduit means into two portions.

6. The roller furnace as defined in claim 1, wherein said first firing means is formed to fire the wares in said firing zone proper for a predetermined period of time, said drying means and said second firing means being formed to dry and biscuit bake the wares for at least as long as said perdetermined period of time, said heat treatment passage having a width wider than that of said firing passage so that when said second moving means moves the wares through said heat treatment passage, said drying means and said second firing means dries and biscuit bakes the wares continuously to produce a stock of the wares that are available to fill said firing passage to capacity at all times for firing by said first firing means.

7. The roller furnace as defined in claim 1, wherein said drying means includes means for recovering heat from both of said first firing means and said second firing means and for conveying said heat recovered to said heat treatment passage.

8. The roller furnace as defined in claim 1, wherein said heat recovery means is formed to recover said heat from said second firing means, said conveying means being formed to convey said heat recovered from said second firing means to said heat treatment passage so that said drying means for drying the wares in said heat treatment passage is independent of said first firing means.

9. A roller furnace producing combustion gases and hot fumes, comprising:

a furnace structure having a furnace axis and defining a firing passage and defining a heat treatment passage parallel to said firing passage, said firing passage having a plurality of zones including a prefurnace zone (11) from which the combustion gases are removable, a preheating zone (12) in which the hot fumes are removable, a firing zone proper (13) formed to accomodate firing of wares at a firing temperature, a forced-air cooling zone (14) into which the wares after firing are enterable and fresh air is introducable to force-air cool the wares and thereby heat the fresh air and thus produce heated air, an air drawing-off zone (15) from which the heated air is removable, a natural cooling zone (16), and a further forced-air cooling zone (17) into which fresh air is introducable and directed to further force-air cool the wares;

first means (4) for moving the wares through at least a portion of said firing passage (3);

second means (7) for moving the wares through said heat treatment passage (6), said first means and said second means each including a movable bed consisting of a plurality of rotary, parallel, and individually drivable rollers each extending transversely of said furnace axis; and means for alternatively utilizing said heat treatment passage as a dryer and as a biscuit-baker-dryer, said heat treatment passage having an initial portion, a middle portion and a terminal portion, said alternatively utilizing means includes drying means communicating with said initial portion, firing means communicating with said middle portion, and cooling means communicating with said terminal portion, said second means for moving being arranged so that the wares move from said initial portion to said middle portion and then to said terminal portion so that a drying by said drying means is performable before a firing by said firing means for biscuit baking the wares and thereby said heat treatment passage is alternatively utilizable as a biscuit-baker-dryer.

10. The roller furnace as defined in claim 9, wherein said firing means includes a burner and means for supplying said burner with comburent air, said supplying means including a fan and associated conduit.

11. The roller furnace as defined in claim 9, wherein said drying means includes means for recovering heat from the hot gases removable from said preheating zone, said means for recovering heat including a fan and associated delivery conduit leading to said heat treatment passage from said preheating zone.

12. The roller furnace as defined in claim 9, wherein said firing means includes a burner producing hot fumes which heat the wares, said cooling means being formed to introduce the fresh air into said terminal portion of said heat treatment passage for cooling the wares that are heated which are moved by said second moving means into said terminal portion, said means for recovering heat being formed to recover heat that is exchanged from the wares heated by the hot fumes from said burner to the fresh air cooling the wares in said terminal portion of said heat treatment passage, said means for recovering heat including a suction fan and associated delivery conduit leading to said intial portion of said heat treatment passage from said terminal portion of said heat treatment passage.

13. A roller furnace comprising:

a furnace structure defining a firing passage and a heat treatment passage, said heat treatment passage having a first and second portion;

means for moving a plurality of wares through each of said firing passage and said heat treatment passage;

first firing means for firing the wares in said firing passage and thereby also produce heat; and means for alternatively utilizing said heat treatment passage for drying only and for drying and biscuit baking and including drying means for drying the wares when the wares are moved into said first portion of said heat treatment passage by said moving means, said alternatively utilizing means also including second firing means for firing the wares when the wares are moved by said moving means into said second portion of said heat treatment passage so as to biscuit bake the wares and thereby also produce heat, said alternatively utilizing means also including heat recovery means for recovering said heat produced from at least one of said firing means, said heat recovery means including means for conveying said heat recovered by said heat recovering means to said first portion of said heat treatment passage.

14. The roller furnace as defined in claim 13, wherein said firing passage and said heat treatment passage are thermally insulated from each other.

15. The roller furnace as defined in claim 13, wherein said moving means is formed to change a speed of the wares moving through said heat treatment passage to suit utilizing said drying means only and to suit utlizing said drying means and second firing means for biscuit baking.

16. The roller furnace as defined in claim 13, wherein said moving means includes a plurality of independently drivable rollers.

17. The roller furnace as defined in claim 13, wherein said first firing means is formed to fire the wares in said firing passage for a predetermined period of time, said drying means and said second firing means being formed to respectively dry and biscuit bake the wares for a total time of at least as long as said predetermined period of time, said heat treatment passage having a width wider than that of said firing passage so that when said moving means moves the wares through said heat treatment passage, said drying means and said second firing means dries and biscuit bakes the wares continuously to produce a stock of the wares that are available to fill said firing passage to capacity at all times for firing by said first firing means.

18. The roller furnace as defined in claim 13, wherein said drying means includes means for recovering heat from both of said first firing means and said second firing means and for conveying said heat recovered to said heat treatment passage.

19. The roller furnace as defined in claim 13, wherein said heat recovery means is formed to recover said heat from said second firing means, said conveying means being formed to convey said heat recovered from said second firing means to said heat treatment passage so that said drying means for drying the wares in said heat treatment passage is independent of said first firing means.

* * * * *